US012790044B2

(12) United States Patent
Jensen et al.

(10) Patent No.: US 12,790,044 B2
(45) Date of Patent: Nov. 10, 2026

(54) POT-FILLING ASSEMBLY

(71) Applicant: Lars Peter Jensen, Rockledge, FL (US)

(72) Inventors: Lars Peter Jensen, Rockledge, FL (US); Stefan Johansson, Saline, MI (US)

(73) Assignee: Lars Peter Jensen, Rockledge, FL (US)

( * ) Notice: Subject to any disclaimer, the term of this patent is extended or adjusted under 35 U.S.C. 154(b) by 0 days.

(21) Appl. No.: 18/993,021

(22) PCT Filed: Jul. 12, 2023

(86) PCT No.: PCT/US2023/027535
§ 371 (c)(1),
(2) Date: Jan. 10, 2025

(87) PCT Pub. No.: WO2024/015468
PCT Pub. Date: Jan. 18, 2024

(65) Prior Publication Data

US 2026/0131919 A1 May 14, 2026

Related U.S. Application Data

(60) Provisional application No. 63/388,377, filed on Jul. 12, 2022.

(51) Int. Cl.
*B65B 1/06* (2006.01)

(52) U.S. Cl.
CPC ..... *B65B 1/06* (2013.01)

(58) Field of Classification Search
CPC ..... B65B 1/06
See application file for complete search history.

(56) References Cited

U.S. PATENT DOCUMENTS 3,337,986 A 8/1967 Boucher
4,020,881 A 5/1977 Nothen
(Continued)

FOREIGN PATENT DOCUMENTS

AU 2019319541 A1 3/2021
EP 3391736 B1 6/2022
(Continued)

OTHER PUBLICATIONS

International Search Report and Written Opinion of the ISA issued in PCT/US2023/027535, mailed Oct. 17, 2023; ISA/US.
(Continued)

*Primary Examiner* — Jason K Niesz
(74) *Attorney, Agent, or Firm* — Harness, Dickey & Pierce, P.L.C.

(57) ABSTRACT

A pot-filler assembly configured to fill a pot with soil. The pot-filler assembly includes a soil hopper and a soil conveyor configured to convey soil out of the hopper and towards the pot. A measuring chamber defines an inner volume, the measuring chamber configured to be adjusted to increase or decrease the inner volume. A funnel is arranged below the measuring chamber. The funnel is movable vertically into and out of the pot when the pot is positioned below the funnel. The funnel is configured to direct soil into the pot. A paper dispenser is configured to arrange a sheet of paper between the funnel and the pot. The funnel is vertically movable to push the sheet of paper into the pot to form a paper pocket within the pot. The funnel is configured to direct soil into the paper pocket.

7 Claims, 4 Drawing Sheets

(56) References Cited

U.S. PATENT DOCUMENTS

| | | | | |
|---|---|---|---|---|
| 5,417,039 | A | 5/1995 | Hansson et al. | |
| 2012/0285580 | A1 | 11/2012 | Ellis | |
| 2013/0213841 | A1 | 8/2013 | Ward | |
| 2016/0122042 | A1* | 5/2016 | Breulmann | B65B 1/06 53/473 |
| 2020/0317382 | A1 | 10/2020 | Savoie-Lavigueur et al. | |
| 2021/0029893 | A1* | 2/2021 | Cooley | A01G 9/027 |
| 2021/0252528 | A1* | 8/2021 | Steingrandt | G01F 11/10 |
| 2022/0127025 | A1* | 4/2022 | Sas Freixenet | B65B 1/06 |

FOREIGN PATENT DOCUMENTS

| | | | |
|---|---|---|---|
| KR | 102250739 | B1 | 5/2021 |
| WO | WO-2020012191 | A1 | 1/2020 |

OTHER PUBLICATIONS

Supplemental European Search Report issued in PCT/US2023/027535, mailed Jun. 23, 2026.

Chinese Office Action from Counterpart CN 202380060537.4, dated Sep. 3, 2026.

* cited by examiner

POT-FILLING ASSEMBLY

CROSS-REFERENCE TO RELATED APPLICATIONS

This application is a U.S. National Phase Application under 35 U.S.C. 371 of International Application No. PCT/US2023/027535, filed on Jul. 12, 2023, which claims the benefit of U.S. Provisional Application No. 63/388,377 filed on Jul. 12, 2022. The entire disclosures of the above applications are incorporated herein by reference.

FIELD

The present disclosure relates to a pot-filler assembly for filling a pot with soil.

BACKGROUND

This section provides background information related to the present disclosure, which is not necessarily prior art.

Filling a bag with soil and placing the bag in a pot (or other growing container) for growing a plant in the pot is an extremely cumbersome and messy process. For example, measuring a desired amount of soil and then transferring the soil into the pot may result in soil being spilled and sometimes wasted. An improved system, assembly, and method for filling a bag with soil and placed in a container would therefore be desirable. The present disclosure advantageously provides for an improved bag-filler and pot assembly, apparatus, and method, which addresses various needs in the art and provides numerous advantages, as explained in detail herein.

SUMMARY

The present disclosure provides for a pot-filler assembly configured to fill a pot with soil. The pot-filler assembly includes the following: a soil hopper; a soil conveyor configured to convey soil out of the hopper and towards the pot; a measuring chamber defining an inner volume, the measuring chamber configured to be adjusted to increase or decrease the inner volume; a funnel arranged below the measuring chamber, the funnel is movable vertically into and out of the pot when the pot is positioned below the funnel, the funnel configured to direct soil into the pot; and a paper dispenser configured to arrange a sheet of paper between the funnel and the pot. Wherein the funnel is vertically movable to push the sheet of paper into the pot to form a paper pocket within the pot, and the funnel is configured to direct soil into the paper pocket.

The present disclosure further provides for a method for filling a pot with soil using a pot-filler assembly. The method includes the following: loading soil into a top hopper of the pot-filler assembly with a upper gate and a lower gate of a measuring chamber closed; adjusting a length of the measuring chamber based to accommodate a predetermined amount of soil to be deposited into the pot; opening the upper gate of the measuring chamber and filling the measuring chamber with soil; positioning the pot beneath the measuring chamber and a funnel of the pot-filler assembly; positioning paper aver the pot; moving the funnel to push the paper down into the pot such that the paper conforms to a shape of the pot; and opening the lower gate of the measuring chamber to release soil from the measuring chamber into the funnel and into the pot.

DRAWINGS

The drawings described herein are for illustrative purposes only of select embodiments and not all possible implementations, and are not intended to limit the scope of the present disclosure.

The accompanying drawings illustrate a pot-filler assembly in accordance with the present disclosure.

DETAILED DESCRIPTION

Example embodiments will now be described more fully with reference to the accompanying drawings.

Figure 1:
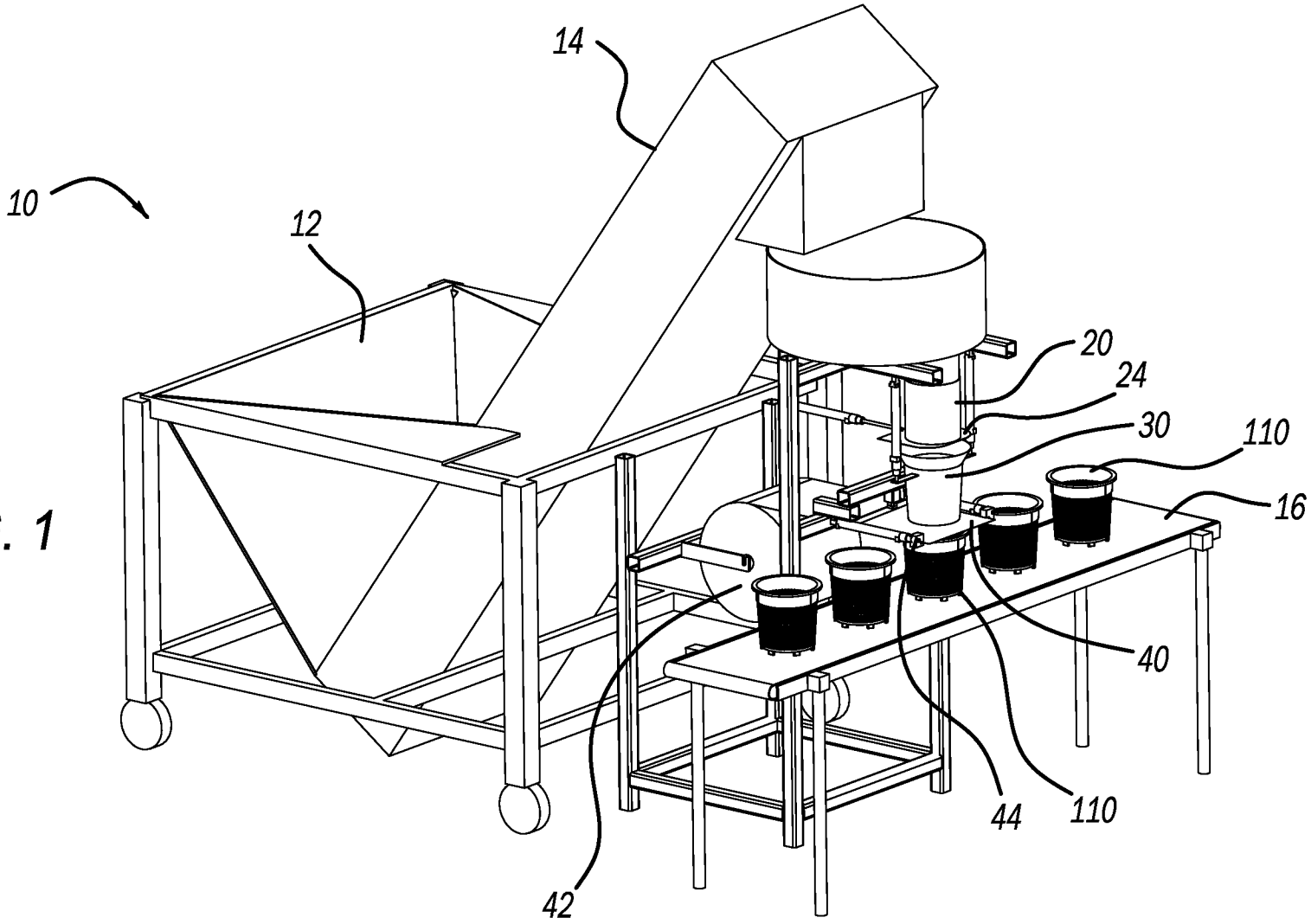
FIG. 1 is a perspective view of a pot-filler assembly in accordance with the present disclosure.
Figure 2:
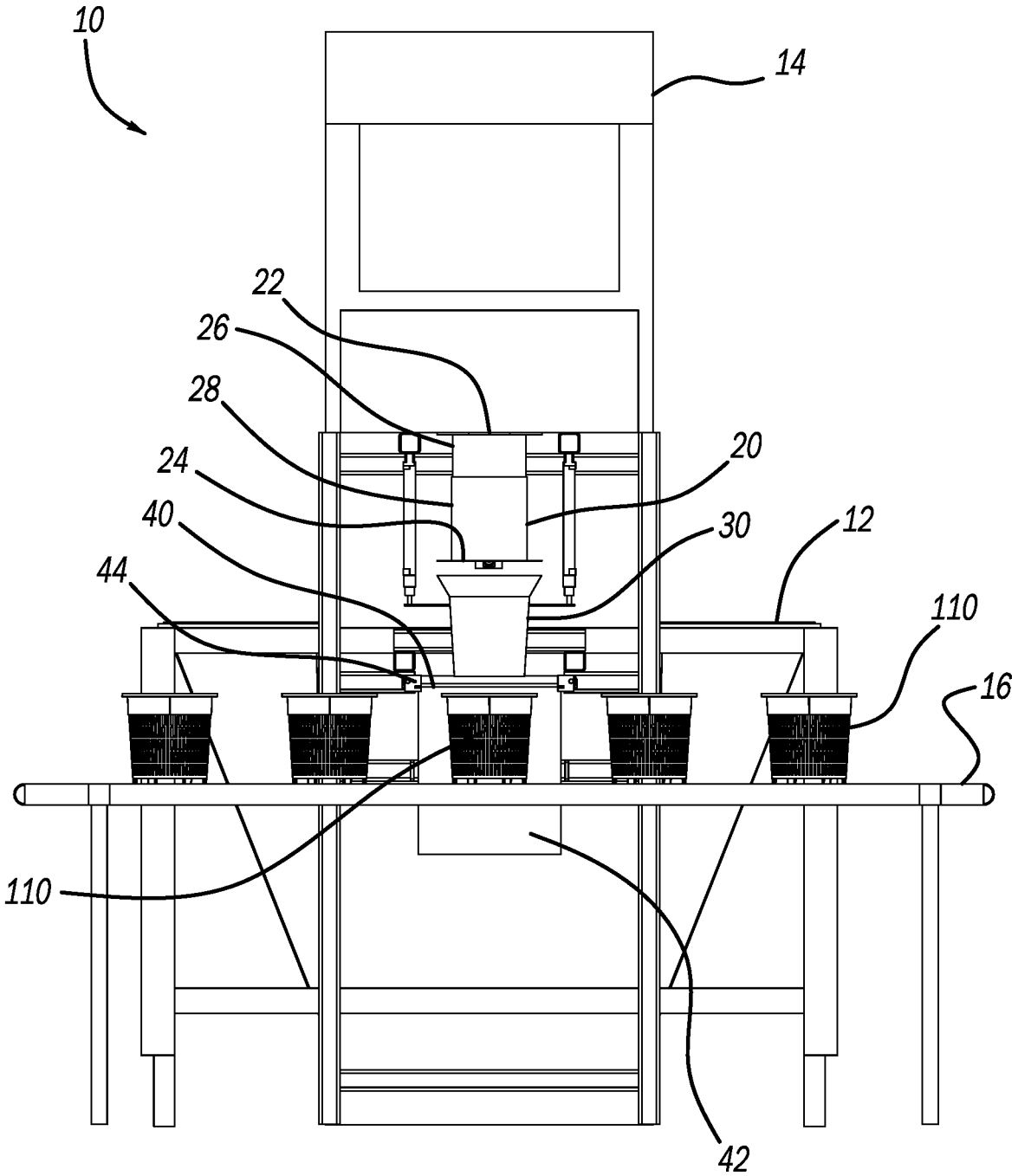
FIG. 2 is a front view of the pot-filler assembly of FIG. 1.
Figure 3:
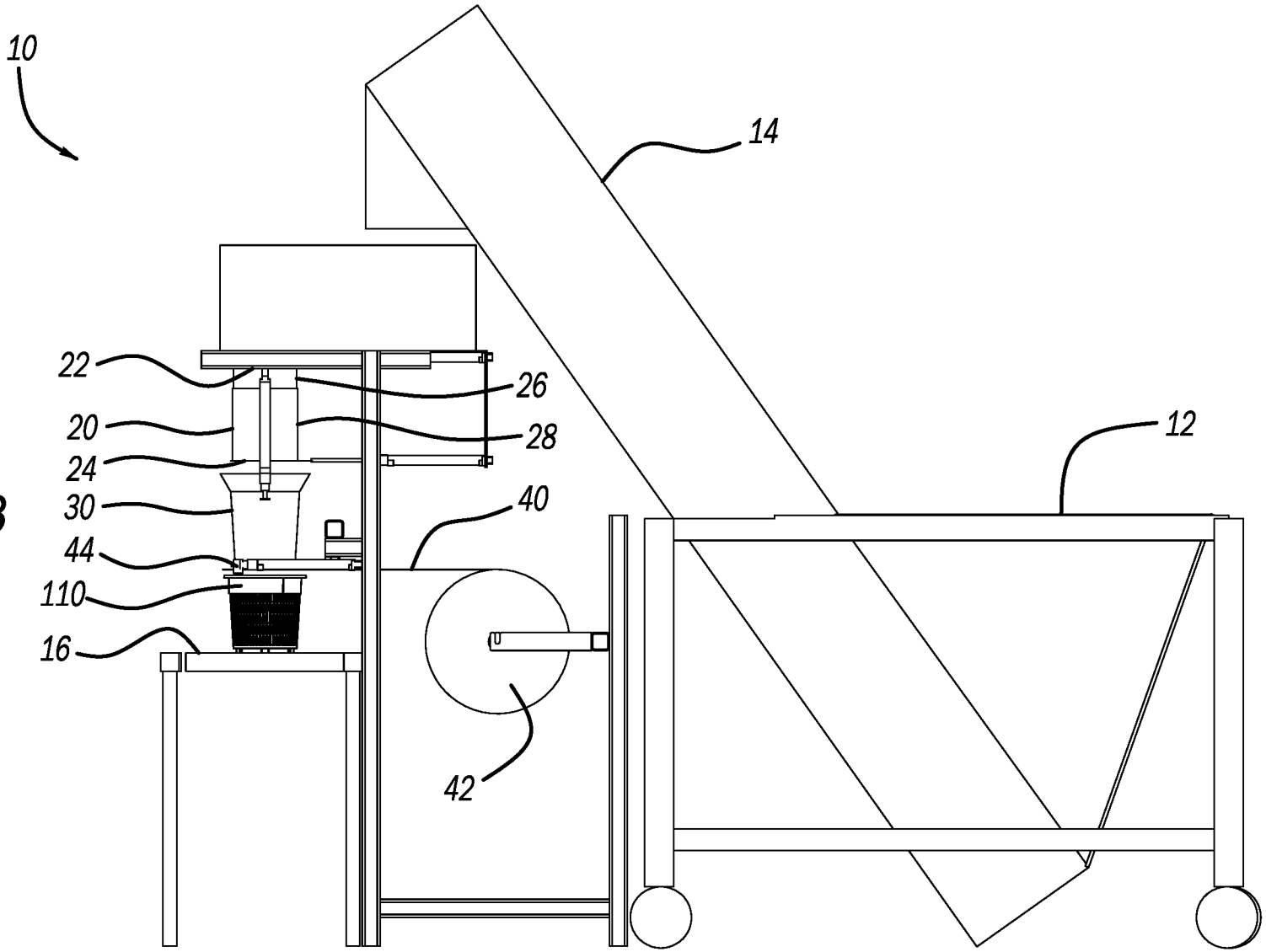
FIG. 3 is a side view of the pot-filler assembly of FIG. 1.
Figure 4:
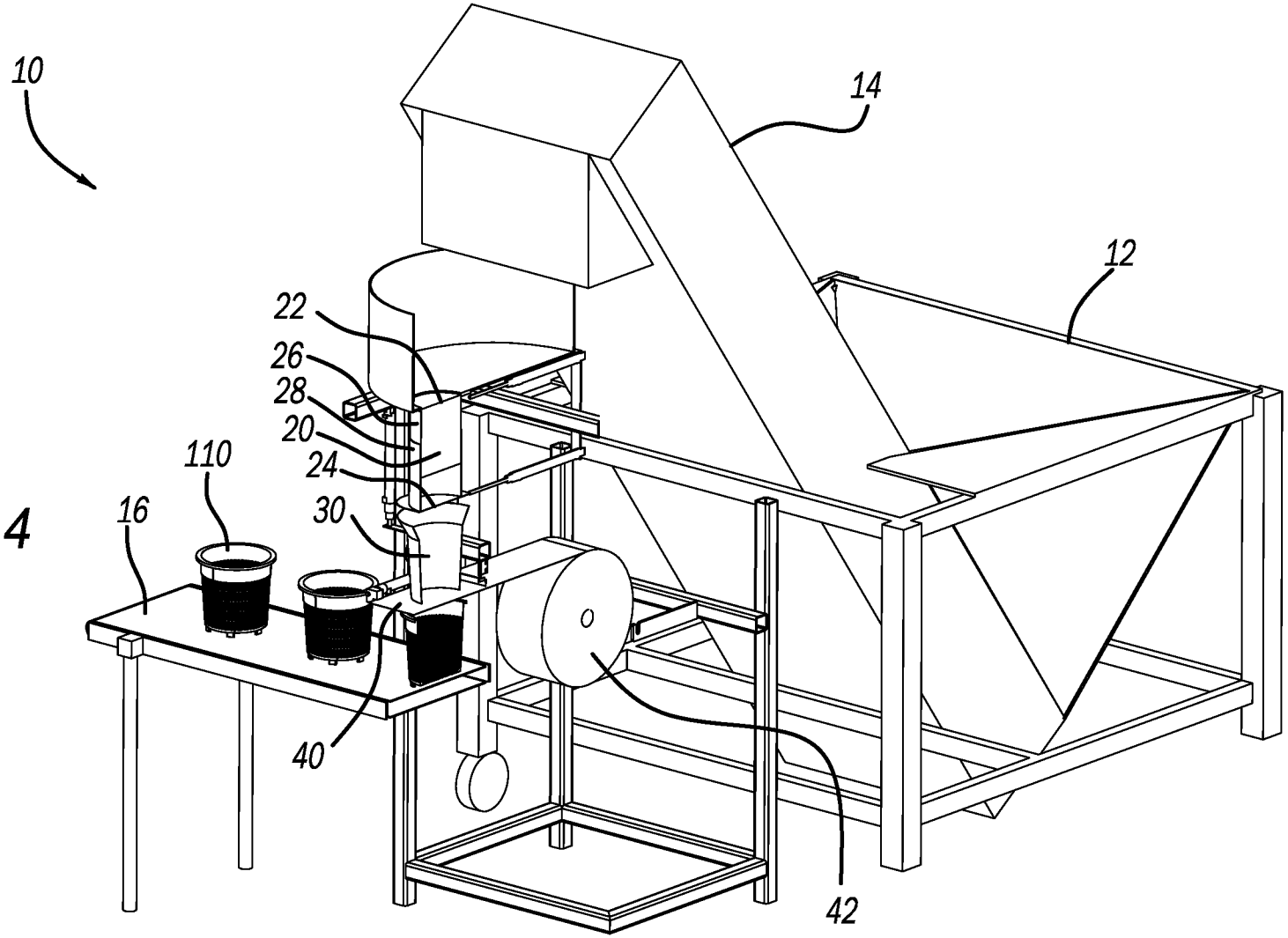
FIG. 4 is a cross-sectional view of the pot-filler assembly of FIG. 1.

FIGS. 1-4 illustrate an exemplary pot-filler assembly 10 in accordance with the present disclosure. The pot-filler assembly 10 includes a soil hopper 12, and a conveyor system 14 extending from the soil hopper 12. Soil to be filled into exemplary pots 110, or any other suitable pot or container, is loaded into the soil hopper 12. The conveyor system 14 coneys the soil from the hopper 12 to the pots 110.

Proximate to a distal end of the conveyor system 14 is a tube 20, which is positioned to receive soil that has been loaded into the soil hopper 12. The tube 20 is a measuring chamber configured to be adjustable in length. The length of the tube 20 corresponds to the amount of soil that will be added to the pot 110. The tube 20 includes a proximal gate 22 and a distal gate 24, which are at opposite ends of the tube 20. The gates 22, 24 may be opened and closed to allow soil to pass into and out of the tube 20.

Below the tube 20 is an inserter 30, which is above a sheet of paper 40 pulled out of a paper roll 42. The inserter 30 may be generally configured as a funnel. Paper 40 pulled from the roll 42 is suspended above the pot 110 to be filled, and below the inserter 30. A plurality of pots 110 to be filled may be arranged on a conveyer 16, which moves the pots 110 to and from a position beneath the inserter 30 and tube 20.

An exemplary process for using the illustrated pot-filler assembly 10 to fill a plurality of pots 110 with soil will now be described. Pots 110 to be filled by the pot-filler assembly 10 are placed along the conveyor belt 16, which transports the pots 110 to and from a filling position beneath the inserter 30 and the tube 20. The length of the tube 20 is set based on the amount of soil to be added to the pot 110. The assembly 10 includes any suitable arm or other mechanism for changing the length of the tube 20. The tube 20 may have a first portion 26 and a second portion 28, which are arranged in a telescoping manner for changing the length of the tube 20. To fill the tube 20, the proximal gate 22 is opened, the distal gate 24 is closed, and soil from the soil hopper 12 is transported into the tube 20. The proximal gate 22 is then closed.

Two pinch blocks 44 on opposite sides of the paper 40 pull the paper 40 out from the roll 42 to the appropriate length past the pot 110 to be filled. The inserter 30 is then actuated to push the paper 40 down into the pot 110 such that the paper 40 conforms to the shape of the pot 110. The bottom gate 24 is opened to release soil from the tube 20. The soil is funneled into the inserter 30, which has pushed the paper 40 down into the pot 110 and is now seated in the pot 110. After the pot 110 has been filled with the soil, a knife is actuated to cut the paper 40. The distal gate 24 is closed, and the pinch blocks 44 release their grip and are retracted to the starting home position in preparation for grabbing additional paper 40 to fill an additional pot 110. The inserter 30, which acted as a soil funnel, is removed out from within the pot 110. The pot 110 now advantageously has a paper liner 40 with soil filled therein. The filled pot 110 is transported by the conveyor 16 away from the inserter 30. Another pot 110 is then transported to beneath the inserter 30 by the conveyor 16 so that the additional pot 110 can be filled with soil in the same manner set forth above. The filling actions set forth through this application may be performed in the order described, or in any other suitable order.

The following is an exemplary list of steps of a method in accordance with the present disclosure for filling a plurality of pots 110 with the pot-filler assembly of the present disclosure (the steps may be performed in the following order, or in any other suitable order): load soil into the top hopper 12; two gates 22, 24 on the adjustable tube 20 are closed; adjusting the length (i.e., height) of the tube 20 determines the soil volume (this is set at the time of the machine setup for a pot to be filled); top gate 22 opens to fill tube 20 with soil; once filled, the top gate 22 is closed; one of the pots 110 is moved into position under the tube 20 and the inserter 30; two pinch blocks 44 on sides of the paper 40 pull the paper 40 out to the appropriate length past the pot 110; the inserter 30 pushes paper 40 down into the pot 110 conforming to the shape of the pot 110; the bottom gate 24 opens to release soil; soil is funneled into the pot 110 by the inserter 30; once soil is in the pot 110, the knife cuts the paper; the bottom soil gate 24 is closed; paper pinchers 44 release their grip and retract to the home position and get ready to grab more paper 40; and the inserter 30 configured as a soil funnel is lifted back up. The pot 110 now has a paper liner 40 with soil filled therein and the conveyor 16 moves to fill the next pot 110.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A pot-filler assembly configured to fill a pot with soil, the pot-filler assembly comprising:

a soil hopper;

a soil conveyor configured to convey soil out of the soil hopper and towards the pot;

a measuring chamber defining an inner volume, the measuring chamber configured to be adjusted to increase or decrease the inner volume;

a funnel arranged below the measuring chamber, the funnel is movable vertically into and out of the pot when the pot is positioned below the funnel, the funnel configured to direct soil into the pot; and a paper dispenser configured to arrange a sheet of paper between the funnel and the pot, the paper dispenser including a roll of paper mounted beneath the soil conveyor;

wherein the funnel is vertically movable to push the sheet of paper into the pot to form a paper pocket within the pot, and the funnel is configured to direct soil into the paper pocket.

2. The pot-filler assembly of claim 1, wherein the measuring chamber is suspended above the funnel.

3. The pot-filler assembly of claim 1, wherein the funnel is configured as an inserter.

4. The pot-filler assembly of claim 1, further comprising a pot conveyor configured to move multiple pots to and away from the funnel.

5. The pot-filler assembly of claim 1, further comprising an upper gate above the funnel and a lower gate below the funnel, the upper gate and the lower gate are configured to be individually actuated to control dispensing of soil into the funnel and out of the funnel.

6. A method for filling a pot with soil using a pot-filler assembly, the method comprising:

loading soil into a top hopper of the pot-filler assembly with a upper gate and a lower gate of a measuring chamber closed;

adjusting a length of the measuring chamber to accommodate a predetermined amount of soil to be deposited into the pot;

opening the upper gate of the measuring chamber and filling the measuring chamber with soil;

positioning the pot beneath the measuring chamber and a funnel of the pot-filler assembly;

positioning paper over the pot;

moving the funnel to push the paper down into the pot such that the paper conforms to a shape of the pot; and opening the lower gate of the measuring chamber to release soil from the measuring chamber into the funnel and into the pot.

7. The method of claim 6, further comprising filling multiple pots with soil using the pot-filler assembly.

* * * * *